United States Patent [19]

Kondo et al.

[11] Patent Number: 4,556,423

[45] Date of Patent: Dec. 3, 1985

[54] AUSTENITE STAINLESS STEELS HAVING EXCELLENT HIGH TEMPERATURE STRENGTH

[75] Inventors: Tatsuo Kondo, Ibaragi; Manabu Tamura, Tokai; Masayuki Tanimura, Yokohama; Yoshiki Kamemura, Tokyo, all of Japan

[73] Assignees: Nippon Kokan Kabushiki Kaisha; Japan Atomic Energy Research Institute, both of Tokyo, Japan

[21] Appl. No.: 454,362

[22] Filed: Dec. 29, 1982

[30] Foreign Application Priority Data

Jan. 8, 1982 [JP] Japan ..... 57-1000

[51] Int. Cl.[4] ..... C22C 38/16

[52] U.S. Cl. ..... 75/125; 75/124; 75/128 W; 75/128 E; 75/128 G; 75/128 F

[58] Field of Search ..... 75/124 C, 124 F, 125, 75/128 W, 128 A, 128 B, 128 C, 128 F, 128 G, 128 E; 148/442, 419; 420/584, 585

[56] References Cited

U.S. PATENT DOCUMENTS

| | | | |
|---|---|---|---|
| 2,523,838 | 9/1950 | Malcolm | 75/124 F |
| 2,536,033 | 1/1951 | Clarke | 75/125 |
| 3,551,142 | 1/1967 | Decroix | 75/125 |
| 3,852,063 | 12/1974 | Niimi et al. | 75/124 F |
| 4,099,966 | 7/1978 | Chivinsky et al. | 75/128 A |
| 4,201,575 | 5/1980 | Henthorne | 75/125 |
| 4,421,557 | 12/1983 | Rossomme et al. | 75/125 |

*Primary Examiner*—L. Dewayne Rutledge
*Assistant Examiner*—Debbie Yee
*Attorney, Agent, or Firm*—Frishauf, Holtz, Goodman & Woodward

[57] ABSTRACT

The high temperature mechanical strength of relatively inexpensive 18-8 stainless steel is improved by adding Cu, Co, Ti and Nb, and the decrease in the ductility caused by the addition of these elements is compensated for by addition of Mg or Y or Ca, Ce and La.

6 Claims, No Drawings

AUSTENITE STAINLESS STEELS HAVING EXCELLENT HIGH TEMPERATURE STRENGTH

BACKGROUND OF THE INVENTION

This invention relates to an austenite stainless steel having an excellent high temperature strength and suitable for use to manufacture boilers, steam turbines, chemical plants and nuclear plants.

Usually, low alloy steel is used as heat resistant steel used at a temperature of less than 600° C., and 18–8 stainless steel is used for temperature above 600° C. However, at temperature above 700° C., the mechanical strength of stainless steel is not sufficiently high so that it can not be used as structural members operating at temperature higher than 700° C. Typical structural members operating at temperature higher than 700° C. include a centrifugal cast tube of HK-40 (25Cr-20Ni-0.4C) and nickel base alloys. However, when these alloys are rolled their strength decreases and they are expensive. Although alloys whose strength is increased by dispersing oxides have also been proposed, they are not only expensive but also difficult to weld. Furthermore, although titanium or niobium was incorporated together with a large quantity of carbon or nitrogen for the purpose of obtaining high strength alloy at low cost, each of such alloy has a defect that its stiffness decreases greatly during use. For use at a temperature lower than the low oxidation potential of a high temperature gas furnace. Hastelloy X or other nickel base super alloys have been investigated, but these alloys are extremely expensive so that it is parctically impossible to use them to construct nuclear power plants or other structures.

SUMMARY OF THE INVENTION

It is an object of this invention to provide an austenite stainless steel having an excellent high temperature strength comparable with that of nickel base super alloys as well as excellent workability so that it is suitable for many applications, for example to manufacture boilers, steam turbines, chemical plants, heat exchangers, control rods and ducts and various component parts of an ordinary nuclear reactors or bleeder type nuclear reactors or nuclear fusion reactors.

According to this invention there is provided an austenite stainless steel having excellent high temperature strength consisting essentially of 0.02–0.2% by weight of carbon, 2% by weight or less of silicon, 2% by weight or less of manganese, 10–25% by weight of chromium, 10–35% by weight of nickel (a portion or whole of the Ni can be replaced with the same quantity of cobalt), 1–8% by weight of molybdenum (a portion or whole of the Mo can be replaced with the same quantity of tungsten), 2–7% by weight of copper, 0.6% by weight or less of aluminum, 0.003–0.05% by weight of magnesium (a portion or whole of the Mg can be replaced with the same quantity of yttrium), and the balance of iron and inherent impurities.

DESCRIPTION OF THE PREFERRED EMBODIMENTS

According to this invention, copper, which has been used only for steel resistant to sulfuric acid and precipitation hardening type stainless steel, is used in a substantial quantity for preparing heat resistant steel. Further, molybdenum (Mo) is used for increasing the solid solution and precipitation effect. In addition, titanium (Ti) and niobium (Nb) are used to control formation of carbides.

The reason for limiting the ranges of respective components is as follows.

With less than 0.02% of carbon (in the following, percentage is weight % unless otherwise specified) the solid solution strengthening performance due to carbides can not be expected, whereas with carbon content larger than 0.2% a large quantity of coarse particles of $M_7C_3$ are formed so that a high temperature and long time are required for preparing a solid solution.

Silicon is an element necessary for deoxidation and for enhancing oxidation resistant property. However, when the quantity of Si increases beyond 2%, the quantity of Si type nonmetalic composition increases thus degrading the quality of the products and requiring a post treatment.

Manganese is also an effective deoxidation agent but when the quantity of Mn exceeds 2% the hot workability is impaired.

At least 10% of chromium is necessary in order to ensure oxidation resistant property at a temperature near 900° C. A larger quantity of Cr is desirable for enhancing solid solution strengthening property and precipitation hardening property caused by $Cr_{23}C_6$ but too much Cr not only renders unstable the austenite structure but also tends to precipitate sigma (Σ) phase which is harmful to stiffness. For this reason the upper limit of Cr is 25% for iron base alloys.

Minimum 10% of nickel is necessary for stabilizing the austenite structure. However, Ni per se is not a fortifying agent. When a quantity of Ni exceeding 35% is incorporated, the austenite stabilizing function becomes saturated and such large quantity of Ni increases the cost. Accordingly, use of 10–35% of Ni is preferred. A portion or whole of the Ni can be replaced with the same quantity of cobalt, with the same advantageous result.

When less than 1% of Mo is incorporated, the solid solution strengthening function and the precipitation strengthening function caused by $M_6C$ type carbide and $Fe_2Mo$ can not be expected, whereas Mo content higher than 8% can strengthen the alloy but increases the tendency of precipitating sigma (Σ) phase or chi (χ) phase which are intermetallic compounds harmful to stiffness. Moreover, more than 8% of Mo makes it difficult to stabilize the austenite phase of iron base alloys. Accordingly, 8% is the upper limit of Mo. A portion or whole of the Mo can be substituted by the same quantity of tungsten (W). When W is contained in the steel alloy $M_6C$ type carbide and $Fe_2W$ precipitate to improve the high temperature strength.

Less than 2% of Cu has no strengthening action, whereas more than 7% of Cu greatly degrades hot workability and weldability so that 2–7% of Cu is advantageous.

The preferred range of Mg is 0.003–0.05%. More particularly, although the quantity of S harmful to the high temperature ductility can be substantially reduced with the present day desulfurization technique, where crystals are sufficiently strengthened with Cu, and Mo or W, and with Nb, Ti or B if desired, the grain interfaces are relatively weakened so that it is necessary to incorporate a minimum of 0.003% of Mg. A quantity of Mg of more than 0.05% forms harmful contaminants and intermetallic compounds which greatly impair the ductility and hot workability of the product. A portion or whole of the Mg can be substituted by the same quantity of Y, with the same advantageous result.

A small quantity of Al is necessary to act as a deoxidation agent but when a large quantity of Al is incorporated carbides tend to coagulate into large particles, thus decreasing the strength. For this reason, 0.6% of Al is the upper limit.

The remainder of the alloy consists of iron and inherent impurities such as P, S and N. Where it is desirable to further improve the high temperature strength and creep rupture ductility, one or more of Nb, Ta and B can be added.

Usually, since Nb contains a small quantity of tantalum which is difficult to separate, in this specification a combination of Nb and Ta is used. As above described, although the austenite steel of this invention can manifest a sufficiently large strength with Cu and Mo or W without incorporating Nb. However, when a small quantity of Nb and Ta is incorporated, carbides are finely dispersed thereby further increasing the high temperature strength. However, with less than 0.01% of Nb and Ta these advantageous result can not be obtained, whereas with Nb and Ta of more than 2% the grains become too fine or grain sizes become unequal with the result that the creep rupture property begins to decrease. When Nb and Ta are incorporated in excess of 2% weldability degrades. For these reasons, the upper limit of Nb and Ta is 2%. A portion or whole of Nb and Ta can be substituted by the same quantity of Ti with the same advantageous effect.

Although without incorporating boron, sufficiently large strength can be obtained, even with an extremely small quantity of boron, precipitation of the carbides at the interfaces between grains is enhanced, thereby improving the creep rupture ductility strength. However, when the quantity of boron exceeds 0.02% weldability degrades.

Steels having the composition of this invention, control steels and alloys were prepared, hot rolled and treated to form solid solutions at a temperature of 1100°-1200° C. Thereafter, the samples were subjected to creep rupture tests in air at 800° C. and the results are shown in the following Table I in which data regarding three typical prior art alloys Incolloy 800, Hastelloy X and Inconel 617 are also shown.

TABLE I

| | chemical composition (wt %) | | | | | | | | | | | | | | | creep rupture test at 800° C., 10 kg/mm$^2$ | |
|---|---|---|---|---|---|---|---|---|---|---|---|---|---|---|---|---|---|
| sample | C | Si | Mn | Cr | Ni | Co | Cu | Al | Ti | Nb | Mo | W | B | Mg | Y | Fe | rupture time (hr) | rupture elongation (%) |
| this invention | | | | | | | | | | | | | | | | | | |
| A | 0.07 | 0.27 | 0.70 | 17.8 | 10.6 | | 4.9 | | | | 2.7 | | | 0.008 | 0.008 | remainder | 317 | 32 |
| B | 0.06 | 0.25 | 0.95 | 12.4 | 18.3 | | 4.8 | | | | 2.8 | | | 0.016 | | remainder | 302 | 27 |
| C | 0.08 | 0.28 | 0.97 | 18.2 | 12.6 | | 4.8 | | | 0.15 | 4.2 | 0.6 | | 0.009 | | remainder | 556 | 25 |
| D | 0.08 | 0.31 | 0.92 | 18.6 | 10.7 | 25 | 4.9 | | 0.12 | 0.20 | 4.5 | 0.5 | | 0.011 | | remainder | 310 | 30 |
| E | 0.06 | 0.30 | 0.93 | 13.7 | 18.1 | | 4.8 | | | 0.40 | 4.9 | | | 0.008 | | remainder | 496 | 23 |
| F | 0.07 | 0.31 | 0.92 | 11.8 | 12.3 | | 4.9 | 0.52 | | 0.25 | 4.9 | | | 0.014 | | remainder | 520 | 26 |
| G | 0.07 | 0.26 | 0.96 | 11.9 | 10.4 | | 3.8 | | 0.41 | 0.70 | 4.8 | | | 0.012 | | remainder | 550 | 15 |
| H | 0.07 | 0.25 | 0.98 | 17.8 | 12.3 | | 4.8 | 0.12 | | 0.18 | 4.9 | | 0.008 | 0.009 | 0.024 | remainder | 610 | 32 |
| I | 0.08 | 0.20 | 0.92 | 14.6 | 12.6 | | 4.9 | | 0.30 | 0.05 | 3.0 | 2.1 | 0.002 | | 0.015 | remainder | 653 | 32 |
| control samples | | | | | | | | | | | | | | | | | | |
| J | 0.06 | 0.25 | 0.99 | 13.2 | 10.9 | | 3.4 | | | | 3.1 | | | | | remainder | 54 | 20 |
| K | 0.07 | 0.24 | 0.96 | 13.4 | 18.1 | | 4.7 | | | 0.15 | 3.2 | | | | | remainder | 300 | 12 |
| L | 0.07 | 0.30 | 0.85 | 12.7 | 12.1 | | | | | | 5.1 | | | | | remainder | 30 | 51 |
| M | 0.07 | 0.32 | 0.87 | 12.9 | 13.4 | | | | | | 5.1 | | | | | remainder | 40 | 43 |
| N | 0.06 | 0.10 | 0.35 | 20.5 | 34.2 | | | | | | 4.9 | | | | | remainder | 36 | 43 |
| O | 0.08 | 0.12 | 0.30 | 20.9 | 35.1 | | | | | | 4.9 | 5.0 | | | | remainder | 641 | 23 |
| P | 0.08 | 0.11 | 0.42 | 21.5 | remainder | | | | | | 20.5 | | | | | 2.5 | 452 | 5 |
| Q | 0.11 | 0.14 | 0.80 | 21.0 | 30.4 | | | 0.35 | 0.50 | 0.23 | | | | | | remainder | 153 | 4 |
| prior art alloys | | | | | | | | | | | | | | | | | | |
| Incolloy 800 | 0.07 | 0.29 | 0.85 | 20.3 | 32.4 | | | 0.44 | 0.45 | | | | | | | remainder | 10 | 30 |
| Hastelloy X | 0.07 | 0.31 | 0.94 | 21.7 | remainder | <0.005 | | | | | 9.0 | 0.5 | | | | 18.3 | 160 | 28 |
| Inconel 617 | 0.07 | 0.15 | 0.20 | 22.4 | remain- | 12.5 | | 1.03 | 0.37 | | 9.0 | | | | | 1.2 | 4000 | 18 |

TABLE I-continued

| sample | chemical composition (wt %) | | | | | | | | | | | | | | | | creep rupture test at 800° C., 10 kg/mm² | |
|---|---|---|---|---|---|---|---|---|---|---|---|---|---|---|---|---|---|---|
| | C | Si | Mn | Cr | Ni | Co | Cu | Al | Ti | Nb | Mo | W | B | Mg | Y | Fe | rupture time (hr) | rupture elongation (%) |
| | | | | | der | | | | | | | | | | | | | |

As an example, sample F of this invention was selected and the Sharpy absorption energies of the sample F and the prior art alloys which had been aged at 700° C. and 800° C. respectively are shown in the following Table II for the purpose of comparing their stiffness at room temperature.

TABLE II

| type | Sharpy absorption energy (kg-m) at room temperature | |
|---|---|---|
| | 700° C., 500 hr | 800° C., 500 hr |
| Sample F | 7 | 5 |
| Incolloy 800 | 10 | 5 |
| Hastelloy X | 5 | 3 |
| SOS316H | 12 | 8 |

As can be noted from Tables I and II, even with samples A and B embodying the invention and their strength were improved with Cu and Mo, the rupture time was greatly increased and their rupture strength was not lowered when compared with the prior art typical steel alloy, Inconel 800. The strength of the samples C–G which were strengthened with Nb, Ti or W were improved greatly, and in sample I and J incorporated with boron, their strength is much higher than Hastelloy X which is a Ni base alloy. In addition, their ductility is sufficiently high. Control samples K and L which were strengthened by Cu and Mo or Cu and Mo and Nb instead of Mg or Y have sufficiently high mechanical strength but their rupture ductility is considerably lower than samples A and B embodying the invention. Although substantially large strength can be obtained by incorporating a large quantity of Mo into a Ni base alloy as in the control alloy Q, instead of incorporating Cu and Nb, but the ductility of such alloy is not sufficient. Use of a large quantity of expensive element Mo violates the object of this invention, that is to obtain steel having a large stiffness at low cost.

As above described, in the steel of this invention the total quantity of Mo (or W), Cr, Ni and Cu which are essential alloying elements is at most 50%, but the steel can manifest comparable or higher strength and ductility to those of prior art Ni base alloys. Since a relatively small quantity of the alloying elements is used, the stiffness at room temperature could be lowered a little, but the stiffness is the same or higher than Hastelloy X alloy, as shown in Table II, which is satisfactory for practical use.

According to another aspect of the invention, suitable quantities of Cu, Mo, Ti and Nb are incorporated into relatively low cost 18-8 stainless steel to increase mechanical strength, and the decrease in the ductility caused by such incorporation is compensated for by the addition of Mg and Y, the elements effective for forming sulfides. Mg and Y may be substituted by another sulfide forming elements such as Ca, Ce and La.

In summary, this invention provides inexpensive iron base steel having excellent high temperature strength comparable with that of nickel base super alloy as well as hot workability and weldability. As a consequence, the steel alloy of this invention is suitable to manufacture boilers, turbines, chemical plants, heat exchangers of high temperature gas furnaces and control rods, ducts, pipes, fuel rod sheaths and vessels of fusion type nuclear reactors, bleeder reactors and fusion reactors.

What is claimed is:

1. Austenite stainless steel having excellent high temperature strength consisting essentially of 0.02–0.2% by weight of carbon, 2% by weight or less of silicon, 2% by weight or less of manganese, 10–25% by weight of chromium, 10–35% by weight of nickel wherein a portion or whole of the nickel can be replaced with the same quantity of cobalt, 1–8% by weight of molybdenum wherein a portion or whole of the molybdenum can be replaced with the same quantity of tungsten, 2–7% by weight of copper, 0.6% by weight or less of aluminum, 0.003–0.05% by weight of at least one of magnesium and yttrium, the total of said chromium, nickel, molybdenum and copper being a maximum of 50% of said steel, and the balance of iron and inherent impurities.

2. The austenite stainless steel of claim 1 wherein said cobalt does not replace said nickel.

3. The austenite stainless steel of claim 1 which further contains at least one of niobium and tantalum in a total of 0.01–2% by weight, and 0.0001–0.2% by weight of boron.

4. The austenite stainless steel of claim 3 wherein said cobalt does not replace said nickel.

5. Austenitic stainless steel having excellent high temperature strength consisting essentially of 0.02–0.2% by weight of carbon, 2% by weight or less of silicon, 2% by weight or less of manganese, 10–25% by weight of chromium, 10–35% by weight of nickel wherein a portion or whole of the nickel can be replaced with the same quantity of cobalt, 1–8% by weight of molybdenum wherein a portion or whole of the molybdenum can be replaced with the same quantity of tungsten, 2–7% by weight of copper, 0.6% by weight or less of aluminum, 0.003–0.05% by weight of at least one element selected from the group consisting of magnesium, yttrium, calcium, cerium and lanthanum, the total of said chromium, nickel, molybdenum and copper being a maximum of 50% of said steel, and the balance of iron and inherent impurities.

6. The austenite stainless steel of claim 5 wherein said cobalt does not replace said nickel.

* * * * *